United States Patent [19]

Okubo et al.

[11] 4,057,934

[45] Nov. 15, 1977

[54] PROTECTION SYSTEM FOR AUTOMATICALLY OPENABLE AND CLOSABLE DOOR

[75] Inventors: Isao Okubo, Katsuta; Takayoshi Ito, Naka; Norihiko Mitsui, Katsuta, all of Japan

[73] Assignee: Hitachi, Ltd., Japan

[21] Appl. No.: 730,853

[22] Filed: Oct. 8, 1976

Related U.S. Application Data

[63] Continuation of Ser. No. 564,220, April 1, 1975, abandoned.

[30] Foreign Application Priority Data

Apr. 5, 1974 Japan ..... 49-37898

[51] Int. Cl.[2] ..... E05F 15/20; B66B 13/24

[52] U.S. Cl. ..... 49/28; 49/363; 187/52 R

[58] Field of Search ..... 187/52 R, 52 LC, 56; 49/26, 27, 28, 138, 360, 363

[56] References Cited

U.S. PATENT DOCUMENTS

| | | | |
|---|---|---|---|
| 2,151,430 | 3/1939 | Lemon | 49/28 |
| 2,432,293 | 12/1947 | Giovanni | 49/28 X |
| 2,998,245 | 8/1961 | Adams | 187/52 R X |
| 3,050,155 | 8/1962 | Karmel et al. | 187/52 |
| 3,403,474 | 10/1968 | Spasoff | 49/360 |
| 3,694,664 | 9/1972 | Carli | 49/28 X |
| 3,916,567 | 11/1975 | Daugirdas | 49/28 |
| 3,922,814 | 12/1975 | Runft | 49/28 |

FOREIGN PATENT DOCUMENTS

| | | | |
|---|---|---|---|
| 6,712,026 | 3/1969 | Netherlands | 49/28 |
| 378,709 | 8/1932 | United Kingdom | 49/28 |
| 1,236,760 | 6/1971 | United Kingdom | 49/28 |
| 256,959 | 11/1969 | U.S.S.R. | 49/28 |

*Primary Examiner*—Evon C. Blunk
*Assistant Examiner*—James L. Rowland
*Attorney, Agent, or Firm*—Craig & Antonelli

[57] ABSTRACT

A protection system for an automatically openable and closable door is provided in which an increase in the driving force produced when the door encounters with a blocking force in the opening operation as caused by some obstacles is detected to stop or reverse the door opening operation, thereby to suppress or reduce any possible accidents.

5 Claims, 9 Drawing Figures

PROTECTION SYSTEM FOR AUTOMATICALLY OPENABLE AND CLOSABLE DOOR

This is a continuation of application Ser. No. 564,220, filed Apr. 1, 1975, now abandoned.

The present invention relates to a protection system for automatically operated doors particularly for those employed in lifts or elevators.

As a protection system for the automatically operated door, it has heretofore been known that an actuating member is provided at the forward end of the door. When an object strikes against the actuating member during the door closing operation, the actuating member is retracted to actuate a control apparatus to thereby stop or reverse the door closing operation. Lately, a system has been developed for practical applications, according to which the door itself serves as the actuating member. When an object collides with the door to prevent the door closing operation, the preventing force is detected and utilized for stopping or reversing the door closing operation.

A feature shared in common by all the hitherto known protection system for the automatic doors can be seen in the fact that protection is secured to passengers or the door only during the door closing operation. However, there happen other kinds of accidents even in the opening operation of the door for an elevator, that is, fingers, skirts of dresses or the like should be nipped between the door and the frame structure thereof in the door opening operation. The conventional protection system can provide no means to deal with such accident. If the fingers or the skirts are nipped, a person resorts to the aid of the elevator attendant to forcibly withdraw the nipped object from the door. For this reason, there occurs serious cases that the finger may be broken or seriously injured or the door itself has to be deformed to release the nipped object such as the finger.

An object of the present invention is therefore to provide a novel protection system for suppressing or reducing the accidents also in the door opening operation such as the nipping of people's fingers by the door and the frame which accidents can not be prevented at all by the heretofore known system.

To accomplish the above object, there is provided according to the invention a protection system for an automatically openable and closable door provided at a doorway, comprising driving means for opening and closing the door, means for detecting an output driving force of the driving means, and control means adapted to stop or reverse the opening operation of the door when the detecting means detects that the output driving force from the driving means exceeds a normal door opening force at the beginning of as well as in the course of the door opening operation.

In a preferred embodiment of the present invention, arrangement is made in such a manner that the protection can be assured for any accidents caused by an object being nipped between the door and the frame not only in the door closing operation but also in the door opening operation.

According to another preferred embodiment of the invention, means having resilient member is provided in the driving force transmitting means between the driving power source and the door. This means remains inactive in the normal operation so that the opening and the closing movement of the door will not be prevented. However, when a resistance to the movement of the door arises in the door opening operation and the resistance force exceeds a force required normally for the opening and the closing of the door, the resilient member is subjected to deformation in the configuration thereof and restored when the abnormal resistance force is removed. The deformation of the resilient member is utilized to actuate control means which serves to stop or reverse at least the door opening operation.

In the following, the present invention will be described by referring to the drawings which show preferred embodiments of the invention only by way of examples and in which.

Figure 1:
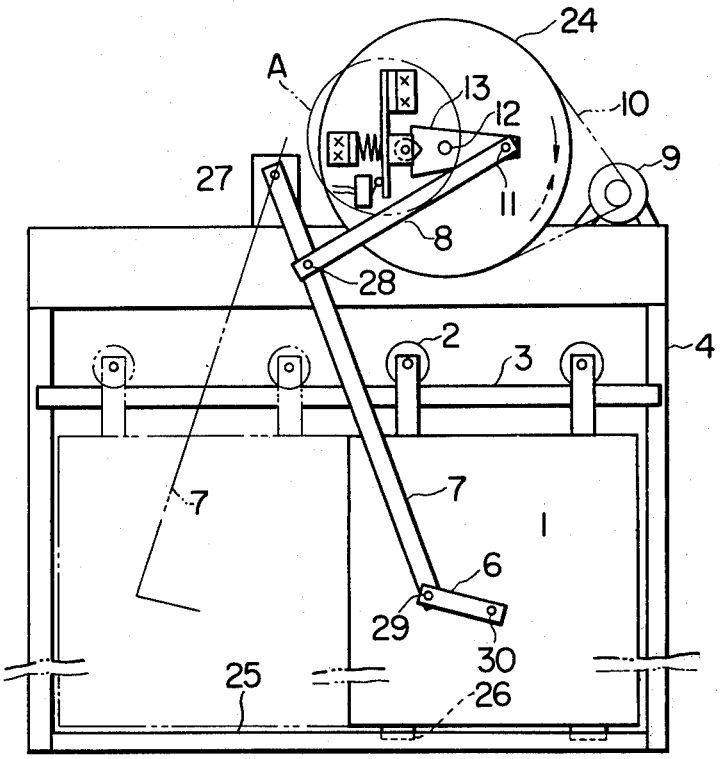
FIG. 1 shows generally a front view of an elevator cage provided with a protection system for an automatically operated door according to the invention.
Figure 2:
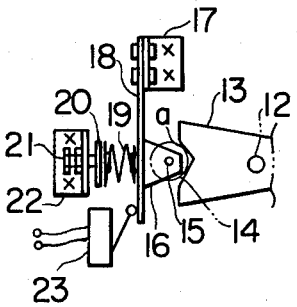
FIG. 2 shows an enlarged fragmental view of the portion encircled by a line A in FIG. 1.
Figure 3:
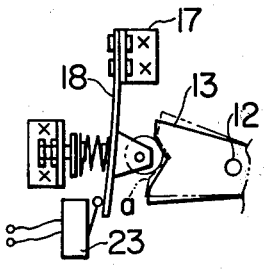
FIG. 3 is to illustrate the operations of a switch employed in the protection system shown in FIG. 1.

Referring to FIGS. 1 to 3 which show an embodiment of the present invention, a door 1 is suspended at the upper side thereof through wheels 2 adapted to be moved on a supporting rail 3, while at the lower side the door is guided by means of door guide shoes 26 slideably fitted in a groove formed in a lower rail or threshold member 25, so that the door may be closed and opened to the right and left, respectively, as viewed in the drawing. A driving electric motor 9 transmits a driving power to a pulley 24 through a chain 10, both ends of which are attached to the pulley thereby to rotate the pulley 24. Provided coaxially with the pulley 24 is a fulcrum 12 of a cam link 13, one end of which is pivotally connected to a connecting link 8 through an articulation point 11. The other end of the connecting link 8 is pivotally connected to an intermediate portion of a main lever 7 at an articulation point 28, which lever 7 in turn is swingably mounted on a frame of a carrier cage 4 at a supporting point 27. The other end of the main lever 7 is pivotally connected to a link 6 at one end thereof at an articulation point 29, while the other end of the link 6 is pivotally connected to the door 1 at the pivotal point 30.

On the other hand, the cam link 13 is formed with a V-shaped notch *a* at the other end thereof into which a roll 14 is pressingly fitted under a constant pressure. In more detail, the roll 14 is secured to a leaf spring 18 by means of a roll mount 16 and a roll shaft 15. The leaf spring 18 is fixedly secured at one end thereof to the driving pulley 24 by means of a mounting bracket 17 and subjected to a pressing force of a compression spring 19 which is mounted on a spring seat member 22 fixed to the driving pulley 24 through a spring force adjusting screw 21 and a seat plate 20.

In this manner, the cam link 13 is operatively engaged with the driving pulley 24 under a coupling force in the range of the combined spring pressure of the leaf spring 18 and the compression spring 19 and they are maintained in the engaging state so far as a force sufficiently strong to overcome the combined spring pressure is not exerted. This engaging state is maintained when the door is normally opened or closed. Reference numeral 23 indicates a switch which is secured to the driving pulley 24 such that it corresponds to the other end of the leaf spring 18.

When the driving motor 9 is energized to rotate, the driving pulley 24 is rotated through the chain 10 in the direction indicated by the arrow of solid line, whereby the main lever 7 is displaced to the two dotted chain-line position by means of the cam link 13 and the connecting link 8 to effect the opening operation of the door 1. To the contrary, upon the rotation of the driving pulley 24 in the direction indicated by the dotted arrow, the main lever 7 is moved to the position shown in the solid line to close the door 1.

Now assuming that a force to prevent or interferring the opening operation of the door 1 is produced in the door opening phase due to, for example, such an accident that a finger or the like is nipped between the door 1 and the frame structure (not shown), this force is transmitted to the main lever 7, connecting link 8 and the cam link 13. When the pressing force applied to the roll 14 is overcome by the above blocking force, the cam link 13 is disconnected from the driving pulley 24. Accordingly, although the driving pulley 24 continues to rotate, the accompanying revolution of the cam link 13 is interrupted so that the roll 14 rotates on the inner surface of the notch *a* to deform the leaf spring 18 into the state shown in FIG. 3. Due to the deformation of the leaf spring 18, the switch 23 is actuated to produce an instruction signal commanding the motor 9 to stop or to reversely rotate so as to close the door again. When the motor 9 is thus rotated in the reversed direction, the driving pulley rotates also reversely to restore the engagement of the roll 14 with the notch *a* to the original state thereby to reverse the rotation of the cam link 13. The door 1 is now moved in the closing direction due to the reverse rotation of the cam link 13, so that the finger or the like nipped between the door and the frame portion can now be released. The door once operated to move in the closing direction in the manner mentioned above is then caused to move normally in the opening direction under the control of a limit switch or the like control mechanism (not shown).

On the other hand, when the force interfering the operation of the door in the door closing phase is produced, the operative coupling between the driving pulley 24 and the cam link 13 is disconnected and the door 1 is moved in the opening direction as the result of the actuation of the switch 23 in a similar manner as in the preceeding case.

As will be understood from the above description of an embodiment of the present invention, due to the provision of the mechanism for coupling the cam link 13 and the door driving pulley 24 with each other under a predetermined force as well as the control apparatus for stopping or reversing the closing or opening operation of the door upon the disconnection of the above-mentioned coupling between the cam link 13 and the door driving pulley 24, not only the accident of something being nipped during the opening operation of the door to which no consideration has hitherto been paid can be suppressed with a minimum danger, but also any possible collision with the door during the door closing operation can be disposed of with minimum danger, if any.

Furthermore, when the guide groove formed in the lower rail 25 is filled with dust to such a degree that a smooth operation of the door is thereby blocked, the movement of the door is then reversed so that any burning accident due to the overload on the rotating drive motor can be effectively evaded. Such protection is not assured in case of the hitherto known system. In the above-described embodiment, both the leaf spring and the spiral spring are employed in consideration of the spatial requirement. However, it should be appreciated that, when one of the spiral and leaf springs can be replaced by a corresponding spring of a great spring force in view of the available space, the other spring may be eliminated with a similar effect or operation to that has been accomplished by the two springs. Moreover, in case of the door for a lift or elevator, the door 1 of the carrier cage is operatively coupled with a door provided at the floor hall through a corresponding linkage mechanism and the both doors are adapted to be simultaneously driven by the motor 9. Accordingly, the accident of something being nipped at the side of the hall door during the movement thereof can be additionally prevented.

Figure 4:
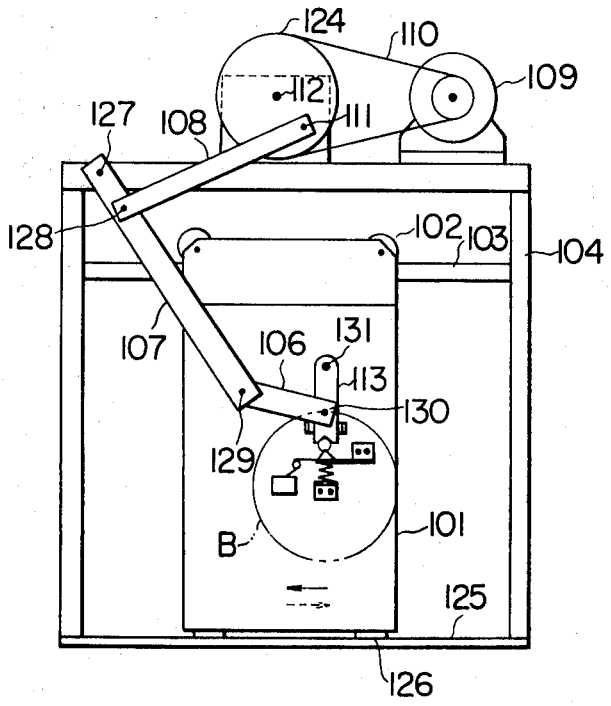
FIG. 4 shows generally a front view of an elevator cage provided with a protection system according to another embodiment of the invention.
Figure 5:
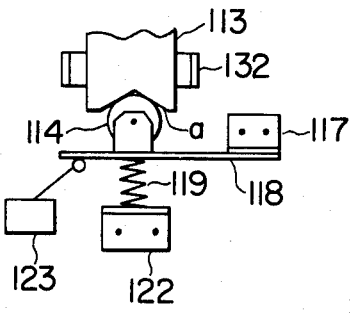
FIG. 5 is an enlarged fragmental view of a portion encicled by line B in FIG. 5.
Figure 6:
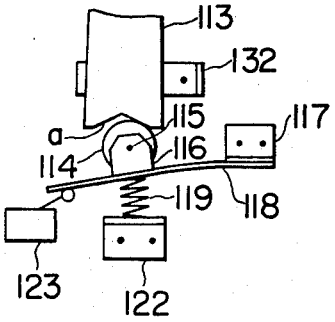
FIG. 6 is to illustrate the operations of a switch employed in the system shown in FIG. 4.

FIGS. 4 to 6 show another embodiment of the invention. In case of this embodiment, a disconnecting apparatus for the coupling between the motor and the door is provided in the door and the link mechanism in place of the driving pulley. Referring to the drawings, a door 101 is supported at the top portion thereof by an upper rail 103 through suspension wheels 102 rotatable on the rail 103, while the lower portion of the door 101 is guided through guide shoes 126 slideably movable in the groove formed in a threshold or lower rail member 125, whereby the door is opened and closed to the right and left, respectively. A driving motor 109 produces a driving power which is transmitted to a driving pulley 124 through a chain 110. The pulley 110 is mounted rotatably around a shaft 112. Connected pivotally to the driving pulley 124 through an articulation point 111 is one end of a link 108, the other end of which is pivotally connected to a main lever 107 at an intermediate portion thereof as indicated by 128. The main lever 107 has one end connected to the carrier cage 104 swingably about a supporting stud 127 and the other end articulated to a link 106 at one end 129. The other end of the link 106 is pivotally connected to a cam link 113 at an intermediate portion thereof as indicated by 130. The cam lever 113 has one end portion pivotally connected to the door 101 at 131 and the other end formed with a V-shaped notch *a* into which a roll 114 is releasably fitted under a predetermined pressure.

In more detail, the roll 114 is mounted on a leaf spring 118 through a roll mount 116 and a roll shaft 115, which spring 118 is fixedly secured to the door 101 at one end thereof through a mounting means 117 and subjected to the pressure of a compression spring 119. The compression spring 119 is supported on a supporting bracket 122 fixed to the door 101. In this manner, the cam link 113 and the door 101 are operatively coupled to each other under a coupling force in the range of the combined spring pressure of the leaf spring 118 and the compression spring 119 and they are maintained in the coupled state unless a force strong enough to overcome the combined spring pressure is exerted. This coupled state is maintained as it is during the normal opening and closing operations of the door.

The reference numeral 123 indicates a switch secured to the door 101 in opposition to the other end of the leaf spring 118, and 132 denotes a stopper for restricting displacement of the cam link 113. The door 101 is opened and closed under the driving force of the motor 109 transmitted through the chain 110, driving pulley 124, link 108, main lever 107, link 106 and cam link 113.

Assuming again that an object is nipped between the door 101 and some portion of the frame structure of the carrier cage 104 during the opening operation of the door as indicated by arrow of solid line, the door 101 is subjected to the force for preventing the opening operation thereof, which force is transmitted also to the cam link 113. If this force is sufficiently great to overcome the pressing force applied to the roll 114, the coupling between the cam link 113 and the door 101 is released. In other words, the cam link 113 receives normally a driving force to open the door 101 through the link 106. However, when the above-mentioned blocking force is produced and exceeds the driving force, the cam link 113 is displaced to the left as shown in FIG. 6 and no driving force is transmitted to the door 101. At the same time, the leaf spring 118 undergoes a deformation as shown in FIG. 6, thereby to actuate the switch 123 to interrupt the current supply to the driving motor 109 to stop the motor or to supply a current to the motor 109 to rotate the motor in the reverse direction after a transient stoppage thereof. Accordingly, upon the actuation of the switch 123, the opening operation of the door is interrupted or after the interruption the door 101 is moved in the reverse or closing direction. Thus, the object nipped during the opening operation can be released from the nipped state.

In a similar manner, when an object is nipped during the door closing operation and a force of the tendency to block the closing operation of the door 101, the coupling between the cam link 113 and the door 101 is released and the door 101 is caused to move in the reverse or opening direction due to the actuation of the switch 123.

The embodiment described above provides similar advantages as those of the preceeding embodiment described with reference to FIGS. 1 to 3. Additionally, in case of the embodiment shown in FIGS. 4 to 6, the switch 123 is disposed at the rear side of the door and the wiring to the switch can be provided in the same manner as the wiring for the conventional door protecting apparatus. Thus, no difficulty will arise in respect of the wiring as compared with respect to the preceding embodiment. Furthermore, since the door and the cam link are pivotally connected to each other in the present embodiment, the cam link can be actuated in response to a slight variation in the movement of the door.

Figure 7:
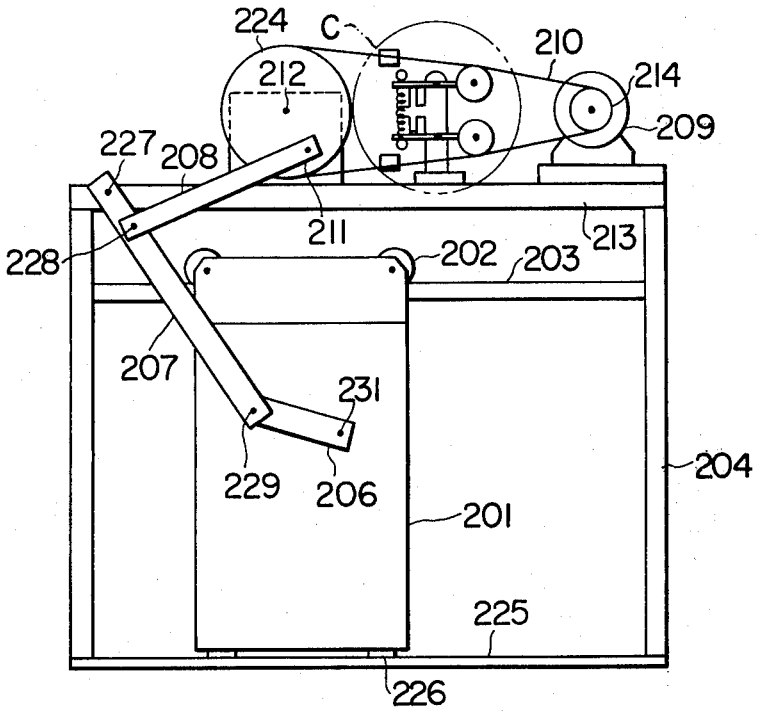
FIG. 7 is a view similar to FIGS. 1 and 4 and shows still another embodiment of the invention.
Figure 8:
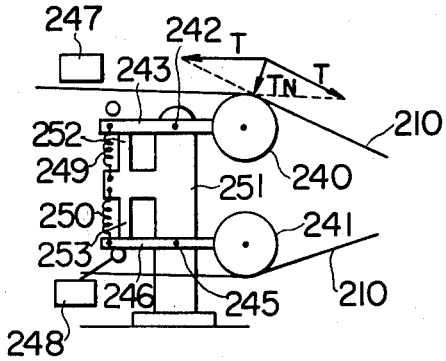
FIG. 8 is an enlarged fragmental view of a portion C in FIG. 7.

FIGS. 7 and 8 show still another embodiment of the present invention. Referring to these figures, a door 201 is suspended at the top portion thereof by an upper rail 203 through suspension wheels 202 movable on the rail 203, while the lower portion of the door 201 is guided by door guide shoes 226 slidably fitted in a groove formed in a threshold member or lower rail 225. A driving motor 209 drives a driving pulley 224 through an endless chain 210 thereby to rotate the pulley 224 about a shaft 212. Connected pivotally to the pulley 224 through an articulation point 211 is one end of a link 208, the other end of which is pivotally connected to an intermediate portion of a main lever 207 at 228. The main lever 207 has one end swingably connected to the frame 213 of a carrier cage 204 at 227 and the other end pivotally connected to a link 206 at one end thereof as indicated by 229. The other end of the link 206 is pivotally connected to the door 201 at an articulation point 231. Provided at the top portion of the frame structure 213 is an upstanding bracket 251 which serves to pivotally support levers 243 and 246 at intermediate pivotal points 242 and 245, respectively. The levers 243 and 246 have at respective one ends sprockets 240 and 241 which are constantly meshed with the drive chain 210, while the respective other ends of these levers 243 and 246 are pulled toward each other by means of tension springs 249 and 250, respectively. Switches 247 and 248 are disposed in the vicinity of the other ends of the levers 243 and 246 in opposition to the tension springs 249 and 250, respectively. Reference numerals 252 and 253 indicate stoppers serving for restricting the rotating amounts of the levers 243 and 246, respectively. The springs 249 and 250 provide tensions which overcome both of the inertia force of the door 201 produced in its opening and closing movements and the tension of the chain 210 due to frictional resistance, thereby to hold the levers 243 and 246 at the positions abutting against the respective stoppers 252 and 253. However, it should be noted that the tensions of the springs 249 and 250 are so selected that the levers 243 and 246 may be rotated through the respective sprockets 240 and 241 when an abnormal tension is produced in the chain 210 as caused by an obstacle object nipped by the door 201.

With the above-described arrangement, the opening and the closing operations of the door 201 are carried out in the following manner:

When the motor 209 is supplied with electric current and a sprocket 214 is rotated in the clockwise direction, the driving pulley 224 is driven also clockwise, whereby the main lever 207 is displaced in the clockwise direction to open the door 201. The closing of the door 201 is effected by reversing the rotation of the motor 209, that is, by driving the motor in the counter-clockwise direction.

Assuming again that the door 201 is encountered with a resistance in its opening movement due to such an accident that a finger is nipped between the door 201 and the frame structure defining the entrance and exit or for any other causes, increase will then occurs in the output torque of the motor in correspondence with the resistance or the increase in the load of the motor 209, which results in the corresponding increase in the component $T_N$ of the tension T of the chain 210. The sprocket 240 is then urged downward and rotates the lever 243 clockwise against the tension exerted by the spring 249. The switch 247 is thus opened to interrupt a circuit for the door opening operation, thereby to stop the door. At the same time, the circuit for the door closing operation is made active to move the door in the closing direction. On the other hand, in case an abnormal resistance appears in the door closing operation, the lever 246 is rotated in the counterclockwise direction through the sprocket 246 to open the switch 248, whereby the door movement reversing circuit is closed.

The embodiment described above with reference to FIGS. 7 and 9 provides advantages similar to those of the preceeding embodiments. Additionally, in case of the present embodiment, the danger of the wires being broken can be effectively reduced, because the switches are fixedly disposed.

From the description of the preferred embodiments of the present invention, it will be appreciated that any serious injuries due to accidents with fingers or the like being nipped between the door and the frame during the door opening operation can be evaded by virtue of the inventive arrangement that, upon occurence of such an accident, the protection apparatus described above immediately responds thereto to stop or reverse the opening movement of the door.

Figure 9:
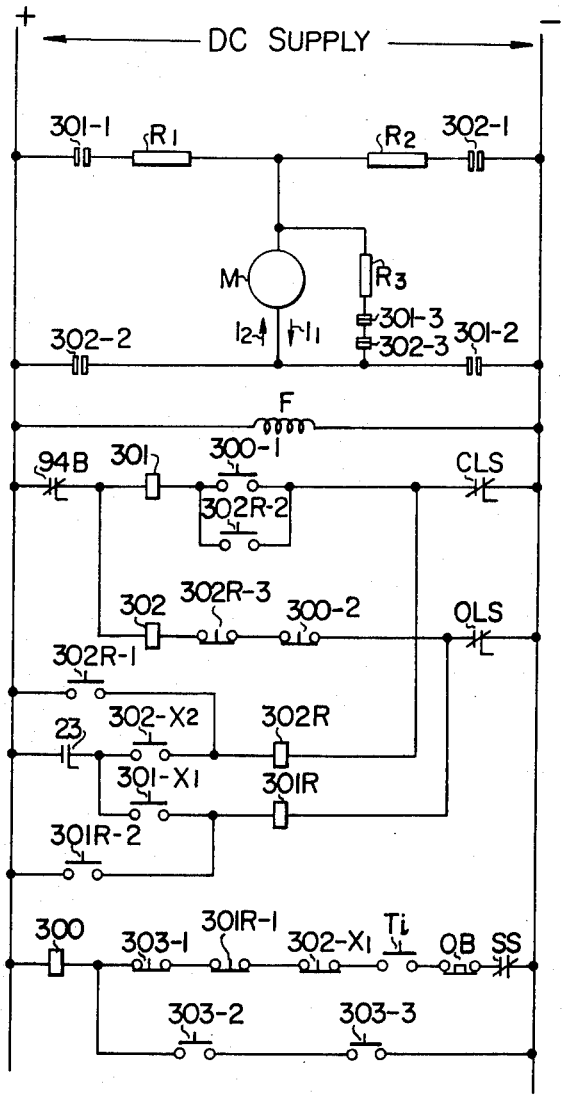
FIG. 9 shows a control circuit for the door operation embodying the teaching of the invention.

FIG. 9 shows a control circuit for an automatically operated door according to the invention, the circuit being applied for the control of an elevator or lift.

In FIG. 9, symbol M designates a D.C. motor having a shunt field coil F, OB designates a door opening button switch, SS designates door safety switch, $R_1$, $R_2$ and $R_3$ designate resistors, 94B designates a switch which is closed during stoppage of the elevator cage. Reference numeral 300 designates a relay for door closing instruction having a normally open contact 300-1, a normally closed contact 300-2 and a normally open contact 300-3. Reference numeral 301 designates a relay for door closing operation having a normally open contact 301-1, a normally open contact 301-2, a normally closed contact 301-3 and a normally open contact 301-$X_1$. Reference numeral 302 designates a relay for door opening operation having a normally open contact 302-1, a normally open contact 302-2, a normally closed contact 302-3, a normally closed contact 302-$X_1$ and a normally open contact 302-$X_2$. Reference numeral 301R designates a relay for door-closure reversing operation having a normally closed contact 301R-1 and a normally open contact 301R-2. Reference numeral 302R designates a relay for door opening reversing operation having a normally open contact 302R-1, a normally open contact 302R-2 and a normally closed contact 302R-3. Symbols CLS and OLS designate normally closed limit switches which are adapted to be open when the door is completely closed and completely opened, respectively. Reference numerals 303-1 and 303-2 designate a normaly closed contact and a normally open contact, respectively, both of which are actuated by a relay (not shown) adapted to be excited for the duration of travelling of the elevator cage. Reference numeral 23 designates the identical switch which has been shown in FIG. 1. Symbol $T_i$ designates a contact of a running control timer.

The operation of the control circuit of FIG. 9 will be now described hereinafter.

When a running command signal for the elevator is produced and the running control timer switch $T_i$ is closed, the relay 300 is excited to close its relay contact 300-1 to thereby excite the relay 301. As a result, the main contacts 301-1 and 301-2 of the relay 301 are closed. Then, current $I_1$ is allowed to flow to the D.C. motor M through the control resistor $R_1$ in the direction indicated by an arrow $I_1$ to thereby close the door. When the closure sensing or limit switch CLS is opened upon completion of closure of the door, the relay 301 is deenergized and a closed loop is formed through the D.C. motor M, the braking resistor $R_3$, the normally closed contact 301-3 and the normally closed contact 302-3 to thereby establish dynamic braking for the motor M. The elevator begins to run and, until it reaches the destination floor, the door closing command relay 300 is self-held through the circuit formed through the closed contacts 303-2 and 300-3. When the elevator cage has reached the destination floor and the elevator running control relay (not shown) is deenergized to thereby open the contact 303-2, the relay 300 is released from the selfholding state to open the contact 300-2 so that the relay 302 is energized. Thus, the main contacts 302-1 and 302-2 of the relay 302 are closed to thereby allow current $I_2$ to flow to the D.C. motor M through the control resistor $R_2$ in the direction indicated by an arrow $I_2$ in FIG. 9, and the door begins to open. Upon the completion of opening of the door, the normally closed limit switch OLS is opened, so that the relay 302 is deenergized and dynamic braking is applied to the motor to stop the door in the same manner as mentioned above.

In the foregoing, the case in which the door is normally operated has been described. When the door movement is restrained by stone pieces or the like filled in the guide groove for the door during the door closing operation mode, an excessively great lock current will flow through the stopped D.C. motor to increase the driving torque thereof, since the relay 301 is energized. Such torque is transmitted to the driving pulley 24 through the chain 10 shown in FIG. 1. Since the link or levers 6, 7 and 8 directly connected to the door is restrained at their positions by the door, the driving torque of the pulley 24 overcomes the spring force provided by the leaf spring 18 and the compression spring 19 to displace the roll 14 to the left and to thereby actuate the switch 23. The relay 301R is in turn energized through the actuated switch 23, the closed contact 301-X and the closed limit switch OLS and is self-held through the closed contact 301R-2. At the same time, the normally closed contact 301R-1 is opened to thereby deenergize the relay 300 and the door is moved in the reverse or opening direction. When the relay 301R is again deenergized upon the completion of opening of the door, the relay 300 is again energized and the door begins to close. If the door again encounters an obstacle in the course, the above-mentioned process is repeated until the obstacle has been removed.

When a hand or finger is nipped between the door and the entrance of the door casing during the door opening operation, a large lock current will flow to the D.C. motor M as is in the case of the door closing operation to thereby close the switch 23. Thereupon, the relay 302R is energized through the closed switch 23, the closed contact 302-$X_2$ and the closed limit switch CLS and is self-held through the closed contact 302R-1 thereof. The relay 302 is inturn energized and the door is moved in the reverse or closing direction. Thus, the nipped hand, finger or the like can now be released. Upon the completion of closure of the door, the closure limit switch CLS is opened to deenergize the relay 302R to thereby initiating the door opening operation.

What we claim is:

1. A protection system for an automatically openable and closable door comprising:

driving means for opening and closing said door;

means for producing a driving force;

means for transmitting said driving force from said driving force producing means to a part of said driving means through a coupling by a frictional force in a normal condition wherein no external force is exerted for obstructing the door throughout at least one of the entire opening and closing operations, a relative displacement being caused in said driving force transmitting means in response to an abnormal condition wherein an external force is exerted on said door obstructing at least one of the opening and closing operations of said door and the output driving force from said driving means exceeds a driving force which is required to at least one of open and close said door in said normal condition, said driving force transmitting means being responsive to the abnormal condition in the door opening operation;

means for detecting the relative displacement caused in said driving force transmitting means; and means for controlling movement of said door for stopping or for stopping and then reversing the at least one of opening and closing operations of said door by controlling said driving force producing means in response to the actuation of said relative displacement detecting means.

2. A protection system for an automatically openable and closable door comprising:

driving means for opening and closing said door;

means for producing a driving force;

means for transmitting said driving force from said driving force producing means to a part of said driving means through a coupling by a frictional force in a normal condition wherein no external force is exerted for obstructing the door throughout at least one of the entire opening and closing operations, a relative displacement being caused in said driving force transmitting means in response to an abnormal condition wherein an external force is exerted on said door obstructing at least one of the opening and closing operations of said door and the output driving force from said driving means exceeds a driving force which is required to at least one of open and close said door in said normal condition, said driving force transmitting means being responsive to the abnormal condition in both the door closing and the door opening operations;

means for detecting the relative displacement caused in said driving force transmitting means; and means for controlling movement of said door for stopping or for stopping and then reversing the at least one of opening and closing operations of said door by controlling said driving force producing means in response to the actuation of said relative displacement detecting means.

3. A protection system for an automatically openable and closable door, comprising:

an electric motor for producing a driving force to open and close said door, a driving pulley operatively coupled to said motor;

a driving force transmitting system for transmitting the driving force from said motor through said driving pulley to said door;

driving force transmitting means provided as a part of said driving force transmitting system, for transmitting the driving force from said motor to said door through a coupling by a frictional force in a normal condition wherein no external force is exerted for obstructing the door throughout at least one of the entire opening and closing operations, a relative displacement being caused in said driving force transmitting means in response to an abnormal condition wherein an external force is exerted on said door obstructing at least one of the opening and closing operations of said door and the output driving force from said motor exceeds a driving force which is required to at least one of open and close said door in said normal condition;

means for detecting the relative displacement caused in said driving force transmitting means; and means for controlling movement of said door for stopping or stopping and then reversing at least one of the opening and closing operations of said door by controlling said motor in response to the actuation of said relative displacement means; and in which said driving force transmitting system includes connecting link means for transmitting the driving force to said door, cam link means having one end coupled to said connecting link means, said cam link means being coupled to a rotary shaft of said driving pulley, and means provided between the other end of said cam link means and said driving pulley for enabling swinging movement of said cam link means with the rotation of driving pulley by a frictional force between said cam link means and said rotary shaft in said normal condition to thereby transmit the driving force from the motor to said door through said driving pulley, said swinging movement enabling means including roll means which is urged by spring means into a V-shaped notch formed at the other end of said cam link means so as to enable said cam link means to be coupled with said rotary shaft of said driving pulley by a frictional force therebetween in said normal condition, said relative displacement being caused between said cam link means and said driving pulley in said abnormal condition.

4. A protection system for an automatically openable and closable door, comprising:

an electric motor for producing a driving force to open and close said door, a driving pulley operatively coupled to said motor;

a driving force transmitting system for transmitting the driving force from said motor through said driving pulley to said door;

driving force transmitting means provided as a part of said driving force transmitting system, for transmitting the driving force from said motor to said door through a coupling by a frictional force in a normal condition wherein no external force is exerted for obstructing the door throughout at least one of the entire opening and closing operations, a relative displacement being caused in said driving force transmitting means in response to an abnormal condition wherein an external force is exerted on said door obstructing at least one of the opening and closing operations of said door and the output driving force from said motor exceeds a driving force which is required to at least one of open and close said door in said normal condition, said driving force transmitting system including connecting link means for transmitting the driving force to said door, cam link means, said connecting link means having one end coupled to said driving pulley and another end coupled to an intermediate portion of said cam link means, and means provided between the other end of said cam link means and said door by a frictional force between said cam link means and said door in said normal condition, said relative displacement being caused between said cam link means and said door in said abnormal condition;

means for detecting the relative displacement caused in said driving force transmitting means; and means for controlling movement of said door for stopping or stopping and then reversing at least one of the opening and closing operations of said door by controlling said motor in response to the actuation of said relative displacement detecting means.

5. A protection system for an automatically openable and closable door, comprising:

an electric motor for producing a driving force to open and close said door, a driving pulley operatively coupled to said motor;

a driving force transmitting system for transmitting the driving force from said motor through said driving pulley to said door;

driving force transmitting means provided as a part of said driving force transmitting system, for transmitting the driving force from said motor to said door through a coupling by a frictional force in a normal condition wherein no external force is exerted for obstructing the door throughout at least one of the entire opening and closing operations, a relative displacement being caused in said driving force transmitting means in response to an abnormal condition wherein an external force is exerted on said door obstructing at least one of the opening and closing operations of said door and the output driving force from said motor exceeds a driving force which is required to at least one of open and close said door in said normal condition, said driving force transmitting means being responsive to the abnormal condition in both the door closing and the door opening operations;

means for detecting the relative displacement caused in said driving force transmitting means; and means for controlling movement of said door for stopping or stopping and then reversing at least one of the opening and closing operations of said door by controlling said motor in response to the actuation of said relative displacement detecting means.

* * * * *